US007258620B1

(12) United States Patent
Willman

(10) Patent No.: US 7,258,620 B1
(45) Date of Patent: Aug. 21, 2007

(54) BOWLING BALL INSERT

(76) Inventor: Todd A Willman, 838 McReynolds NW., Grand Rapids, MI (US) 49504

( * ) Notice: Subject to any disclaimer, the term of this patent is extended or adjusted under 35 U.S.C. 154(b) by 0 days.

(21) Appl. No.: 11/436,417

(22) Filed: May 18, 2006

Related U.S. Application Data

(60) Provisional application No. 60/682,188, filed on May 18, 2005.

(51) Int. Cl.
*A63B 37/00* (2006.01)

(52) U.S. Cl. ..... 473/129; 473/130

(58) Field of Classification Search ..... 473/125–130
See application file for complete search history.

(56) References Cited

U.S. PATENT DOCUMENTS

| | | | | |
|---|---|---|---|---|
| 2,273,199 | A | 2/1942 | Hilton et al. | |
| 2,469,268 | A | 5/1949 | Jerome | |
| 2,482,190 | A | 9/1949 | Kramer | |
| 2,646,985 | A | 7/1953 | Nagy et al. | |
| 2,708,578 | A | 5/1955 | Mitchell | |
| 2,777,693 | A | 1/1957 | Mitchell | |
| 2,973,205 | A | 2/1961 | Mitchell | |
| 2,979,334 | A | 4/1961 | Mitchell | |
| 2,983,511 | A | 5/1961 | Stott | |
| 3,055,661 | A * | 9/1962 | Mitchell | 473/130 |
| 3,078,097 | A | 2/1963 | Mitchell | |
| 3,113,775 | A | 12/1963 | Taylor | |
| 3,266,804 | A | 8/1966 | Carter | |
| 3,271,031 | A | 9/1966 | Mitchell | |
| 3,342,488 | A | 9/1967 | Novatnak | |
| 4,289,312 | A | 9/1981 | Heimbigner | |
| 4,328,968 | A | 5/1982 | Hacker | |
| 4,358,112 | A | 11/1982 | Straborny | |
| 4,416,452 | A | 11/1983 | Heimbigner | |
| 4,432,546 | A | 2/1984 | Allen, Jr. | |
| 4,530,502 | A | 7/1985 | Yamane | |
| 4,569,520 | A | 2/1986 | Yamane | |
| 4,585,230 | A | 4/1986 | Martin | |
| 4,623,149 | A | 11/1986 | Herman | |
| 4,699,380 | A | 10/1987 | Mace | |
| 4,890,836 | A | 1/1990 | Goldie | |
| 4,892,308 | A | 1/1990 | Gaunt | |
| 4,968,033 | A | 11/1990 | Aluotto | |
| 5,002,276 | A | 3/1991 | Bernhardt | |
| 5,002,277 | A | 3/1991 | Ontko | |
| 5,007,640 | A | 4/1991 | Bernhardt | |
| 5,123,644 | A | 6/1992 | Bernhardt | |
| 5,176,378 | A | 1/1993 | Bernhardt | |

(Continued)

*Primary Examiner*—William M. Pierce
(74) *Attorney, Agent, or Firm*—Van Dyke, Gardner, Linn & Burkhart, LLP

(57) ABSTRACT

A bowling ball insert may be installed within a respective one of the finger holes of a bowling ball and includes a sleeve, at least one removable finger pad, and may include at least one spacer. The sleeve is mounted within the finger hole and the finger pad and spacer may be detachably mounted within the sleeve using hook and loop fastener material or the like. The finger pad and spacer may be constructed with various geometric forms and the finger pad may also include various types of outer layers to tailor the finger hole of the bowling ball to the size, fit, and feel preferences of a bowler, in order to improve comfort and control while bowling. The sleeve, spacer, and/or finger pad include notches that enable removal of the finger pad and spacer from the sleeve.

14 Claims, 6 Drawing Sheets

U.S. PATENT DOCUMENTS 5,261,660 A 11/1993 Rowland
5,330,392 A 7/1994 Bresin et al.
5,498,209 A 3/1996 Arutunian
5,520,582 A 5/1996 Lathrop
5,704,843 A 1/1998 Oosterlaak et al.
5,738,592 A * 4/1998 Saunders ..... 473/130
5,795,236 A 8/1998 Alberts et al.
5,800,276 A 9/1998 Hill
6,238,297 B1 5/2001 Tilton
6,508,718 B2 1/2003 Albert et al.
6,736,734 B1 5/2004 Bernhardt

* cited by examiner

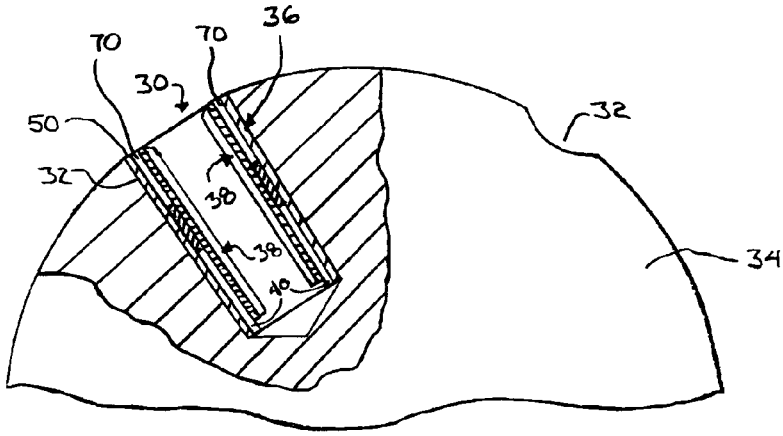
FIG. 1
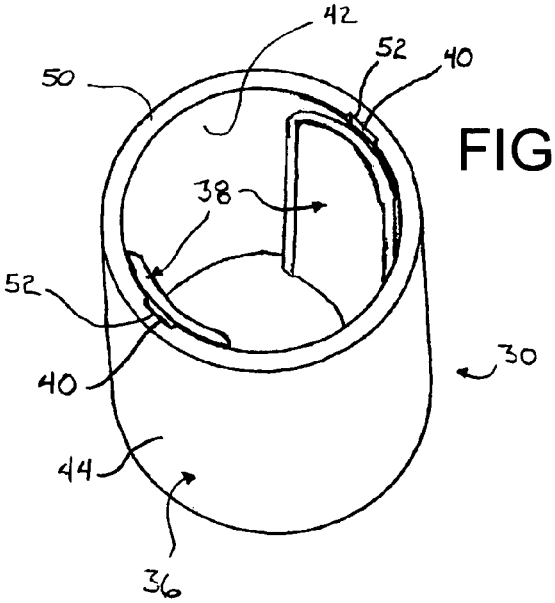
FIG. 2
FIG. 3
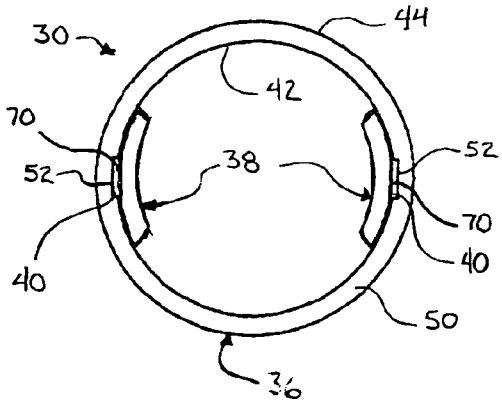

FIG. 4
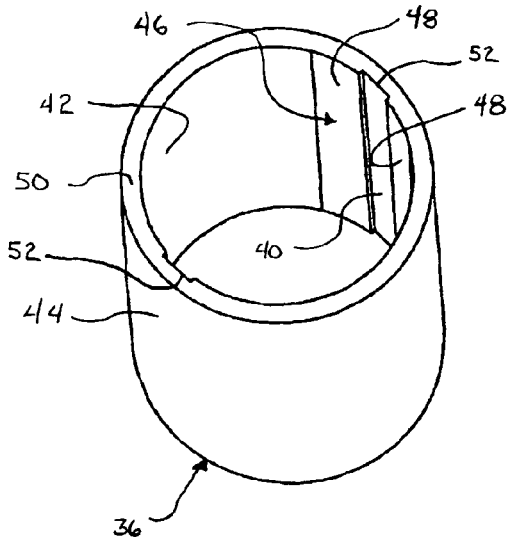
FIG. 6
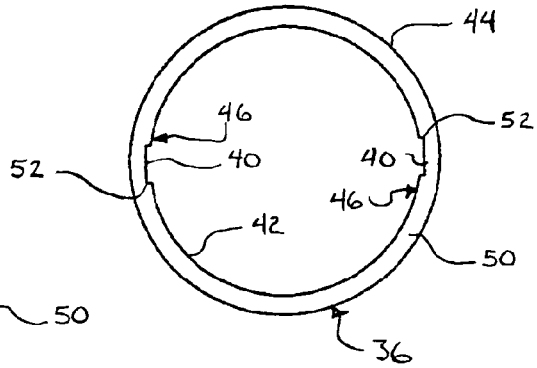
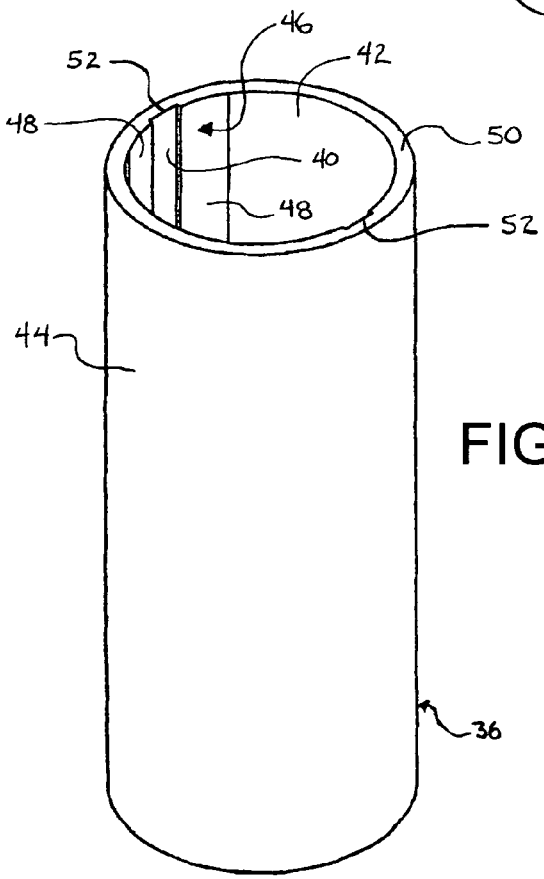
FIG. 5

FIG. 12
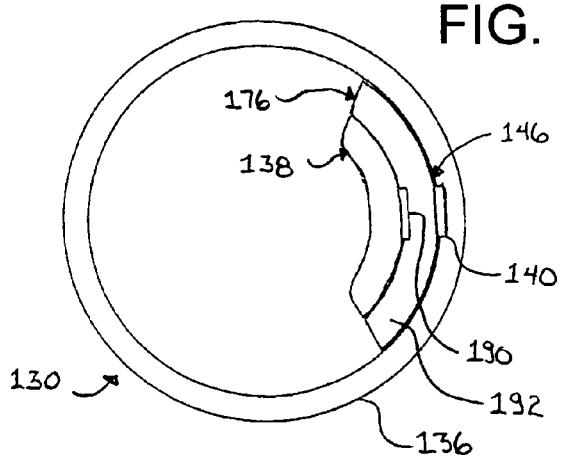
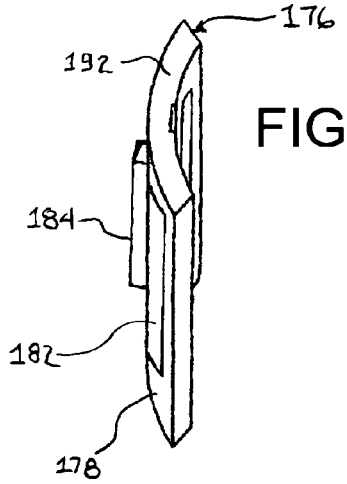
FIG. 15
FIG. 13
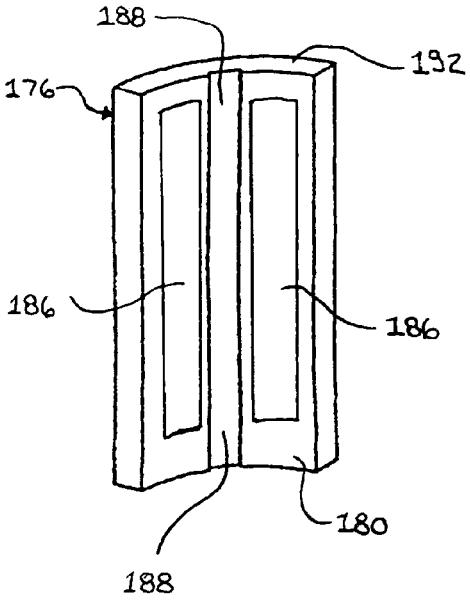
FIG. 14
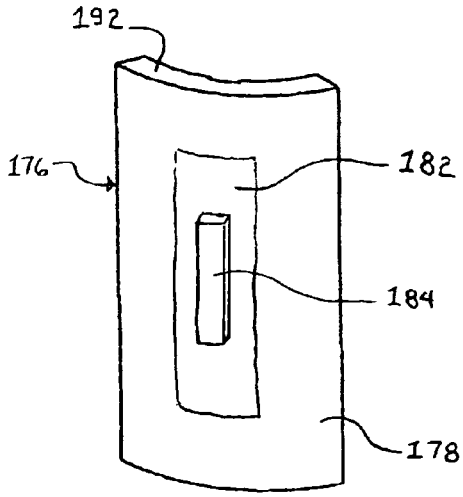

FIG. 16
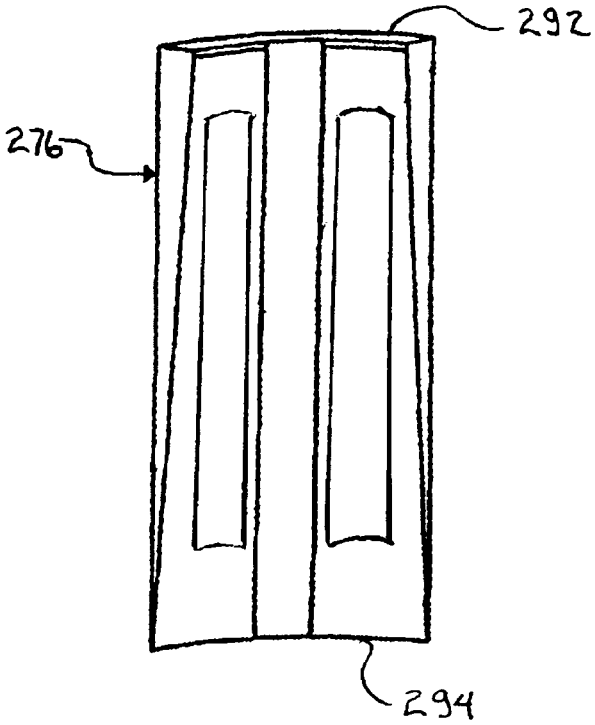
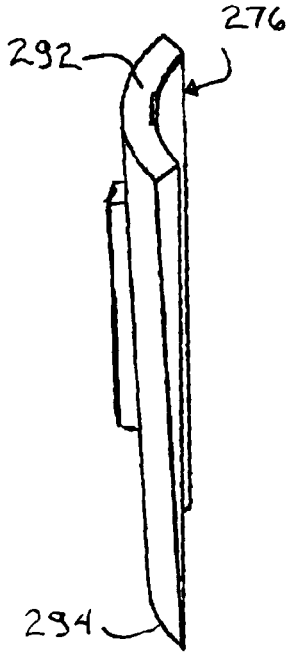
FIG. 17
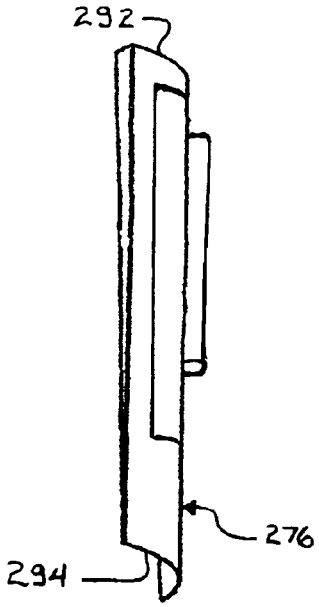
FIG. 18
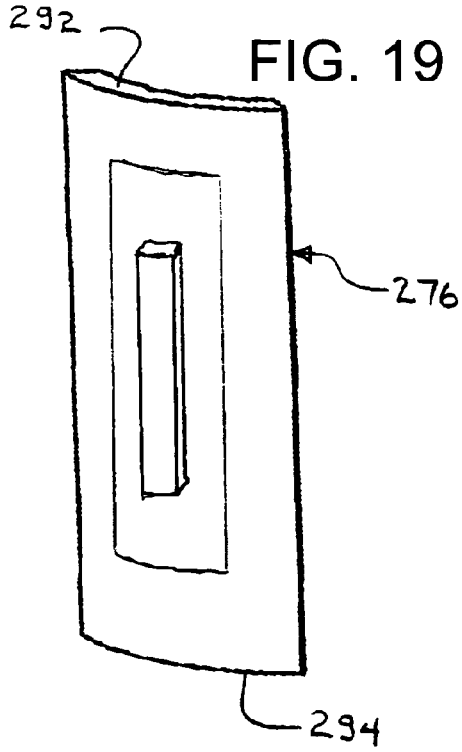
FIG. 19

BOWLING BALL INSERT

CROSS REFERENCE TO RELATED APPLICATION

The present application claims priority of U.S. provisional application Ser. No. 60/682,188, filed May 18, 2005, by Todd A. Willman for a BOWLING BALL INSERT, which is hereby incorporated herein by reference in its entirety.

BACKGROUND OF THE INVENTION

The present invention relates to a bowling ball insert for the finger holes of a bowling ball.

Bowling is a well-known, indoor sport that is enjoyed by a large number of individuals. As with any sport utilizing equipment, the participant's technique, the quality of the equipment, and the matching of the equipment to the participant are critical to both the successful performance of the bowler and the avoiding of injuries.

In bowling, the selection of the bowling ball to suit the player is critical. One of the most important features of the bowling ball that must be matched to a player is the configuration of the finger holes of the bowling ball relative to the player's fingers. An ill fitting bowling ball in this regard can cause blisters, or chafing, or worse, and can result in lower bowling scores.

Similarly, a bowler's technique will suffer when the finger holes of a bowling ball are improperly sized or configured to the bowler's fingers. For example, if the finger holes are too large relative to the bowler's fingers, the bowler will naturally compensate by "squeezing." Squeezing is the application of excessive pressure by the bowler's fingers by bending either the thumb or finger, or both, at the first knuckle to prevent the ball from prematurely being released from the player's hand. Squeezing results in a decrease in control due to improper release of the ball, as well as the possibility of swelling, blisters, and/or calluses.

Numerous products and devices are available to attempt to provide a correctly sized finger hole or to compensate for the effects of improperly sized holes. For example, powder and resin may be applied to a bowler's fingers to alter the feel of the ball. Powder and resin, however, must be continually reapplied and are also impacted by the amount of moisture, such as from perspiration, present on a bowler's hand. Similarly, numerous styles and types of bowling ball insert devices are available, but such devices suffer from a lack of versatility and adaptability, and/or require a trained technician to adjust for the particular bowler.

Therefore, a versatile, consistent, and easy to use manner of conforming a finger hole of a bowling ball to match a bowler's finger is desired that provides a comfortable fit between the ball and finger, that helps to promote proper bowling technique, and that may be readily altered by the bowler.

SUMMARY OF THE INVENTION

The present invention provides a bowling ball insert that is readily tailored to match the size and shape of a bowler's finger, as well as to conform the fit and feel of the bowling ball finger holes to the personal preferences of the bowler. In one embodiment of the present invention, a bowling ball insert may be installed within one or more of the finger holes of a bowling ball and includes a sleeve, at least one removable finger pad, and may include at least one spacer. The sleeve is mounted within the finger hole and the finger pad and spacer may be detachably mounted within the sleeve using hook and loop fastener material, such as VELCRO® or the like. The finger pad and spacer may be constructed with various geometric forms and the finger pad may also include various types of outer layers to tailor the finger hole of the bowling ball to the size, fit, and feel preferences of a bowler, in order to improve comfort and control while bowling. The sleeve, spacer, and/or finger pad may include notches that enable easy and quick removal of the finger pad and spacer from the sleeve.

According to an aspect of the present invention, a bowling ball insert intended for installation in a hole of a bowling ball comprises a sleeve having an exterior surface and an interior surface, at least one insert member receptacle located on the interior surface of the sleeve, and at least one finger pad having a grip side and an attachment side. The finger pad includes a finger pad fastening element on the attachment side, and the insert member receptacle includes an insert member fastening element and a sleeve notch. The finger pad fastening element is adapted to enable the finger pad to be detachably secured to the sleeve, with the sleeve notch aiding removal of the insert member.

According to another aspect of the present invention, a bowling ball insert intended for installation in a hole of a bowling ball comprises a sleeve having an exterior surface and an interior surface, at least one insert member receptacle located on the interior surface of the sleeve, at least one finger pad having a pad grip side a pad attachment side, and at least one spacer having first and second pad sides. The finger pad includes a finger pad fastening element on the pad attachment side, and the spacer includes a first spacer fastening element on the first spacer side, and a second spacer fastening element and a spacer notch on the second spacer side. The insert member receptacle includes an insert member fastening element and a sleeve notch. The first spacer fastening element and the insert member fastening element enable the spacer to be detachably secured to the sleeve with the sleeve notch being adapted to aid removal of the spacer from the sleeve. The finger pad fastening element and the second spacer fastening element enable the finger pad to be detachably secured to the spacer with the spacer notch being adapted to aid removal of the finger pad from the spacer.

According to another aspect of the present invention, a bowling ball insert intended for installation in a hole of a bowling ball comprises a sleeve having an exterior surface and an interior surface, at least one insert member receptacle located on the interior surface of the sleeve, at least one finger pad having a pad grip side and a pad attachment side, and at least one spacer having first and second spacer sides. The insert member receptacle includes an insert member fastening element and a sleeve notch, and the finger pad includes a finger pad fastening element on the pad attachment side. The spacer includes a first spacer fastening element on the first spacer side, a second spacer fastening element on the second spacer side, and a spacer notch on the second spacer side. The first spacer fastening element and the insert member fastening element enable the spacer to be detachably secured to the sleeve with the sleeve notch being adapted to aid removal of the spacer from the sleeve. The finger pad fastening element and the second spacer fastening element enable the finger pad to be detachably secured to the spacer with the spacer notch being adapted to aid removal of the finger pad from the spacer.

The bowling ball insert of the present invention provides a durable device that enables a bowler to quickly and easily tailor the size, fit, and feel of the finger holes of a bowling ball to the bowler's personal preferences. The finger pad provides a comfortable, cushioned conforming gripping location for a bowler's finger that eliminates excess movement and prevents blisters and chafing while improving a bowler's performance. In addition, the hydrophobic nature and smooth surface of the outer layer of the finger pad enable a smoother release of the bowling ball. The spacers and finger pads may enable a bowler to modify the bowling ball inserts to conform to a desired feel and, if a ball is used by different bowlers, enable the bowling ball inserts to be conformed to the differently shaped and sized fingers of such users. The finger pads and spacers remain securely retained within the bowling ball insert due to the inclusion of various fastening elements and, optionally, locating tabs. The sleeve notches, spacer notches, and cutouts enable the finger pads and spacers of the bowling ball inserts to be quickly and easily replaced by the bowler without the assistance of bowling technicians.

These and other objects, advantages, purposes and features of the present invention will become apparent upon review of the following specification in conjunction with the drawings.

BRIEF DESCRIPTION OF THE DRAWINGS

FIG. 1 is a partial sectional view of a bowling ball insert of the present invention installed in a bowling ball;

FIG. 2 is a perspective view of the bowling ball insert of FIG. 1 shown removed from the bowling ball;

FIG. 3 is a top end view of the bowling ball insert of FIG. 2;

FIG. 4 is a perspective view of the sleeve of the bowling ball insert of FIG. 2;

FIG. 5 is a perspective view of the sleeve of the bowling ball insert of FIGS. 2-4;

FIG. 6 is a top end view of the sleeve of FIG. 5;

FIG. 12 is a top end view of another bowling ball insert of the present invention that includes a spacer;

FIG. 13 is a front perspective view of the spacer of the bowling ball insert of FIG. 12, shown removed from the bowling ball insert;

FIG. 14 is a rear perspective view of the spacer of FIG. 13;

FIG. 15 is a side perspective view of the spacer of FIGS. 13 and 14;

FIG. 16 is a front perspective view of an another spacer for use with the bowling ball insert of the present invention;

FIG. 17 is a side perspective view of the spacer of FIG. 16;

FIG. 18 is an opposite side perspective view of the spacer of FIGS. 16 and 17;

FIG. 19 is a rear perspective view of the spacer of FIGS. 16-18;

DESCRIPTION OF THE PREFERRED EMBODIMENTS

Figure 7:
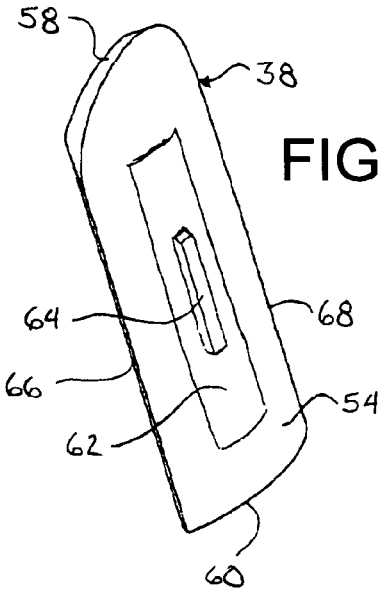
FIG. 7 is a rear perspective view of a finger pad of the bowling ball insert of FIGS. 1-3, shown removed from the sleeve.
Figure 8:
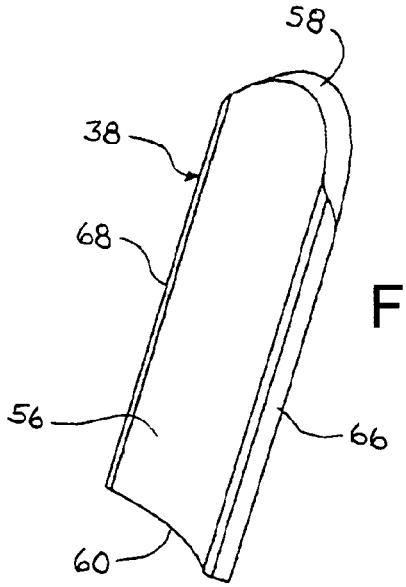
FIG. 8 is a front perspective view of the finger pad of FIG. 7.
Figure 9:
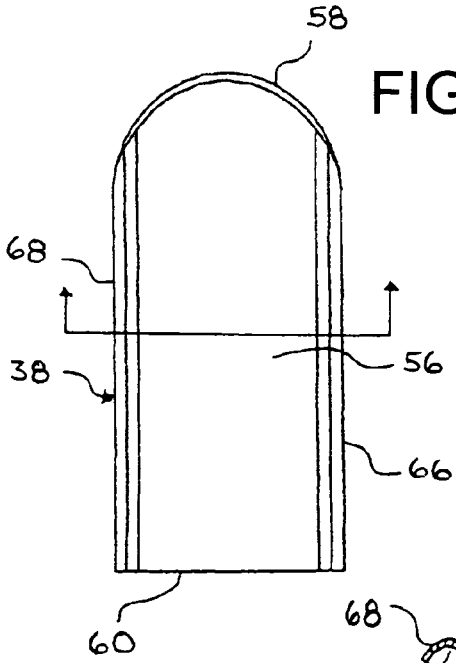
FIG. 9 is a front elevation view of the finger pad of FIGS. 7 and 8.

The present invention will now be describe with reference to the accompanying figures, wherein the numbered elements in the following written description correspond to like-numbered elements in the figures. A bowling ball insert 30 is positioned within a finger hole 32 of a bowling ball 34 (FIG. 1). Bowling ball insert 30 may be used within one or more of the finger holes 32 of a bowling ball 34, where the finger holes 32 are adapted to receive a bowler's thumb or fingers.

As shown in FIGS. 1-3, bowling ball insert 30 includes an acceptor sleeve or sleeve 36 and a pair of removable finger pads 38, with sleeve 36 including a pair of sleeve pockets, or sleeve indents, or sleeve notches 40 (FIG. 6), and the finger pads 38 each being positioned over a respective sleeve notch 40 within sleeve 36. The sleeve notches 40, as described in detail below, enable the finger pads 38 to be readily removed from sleeve 36 such that alternatively sized or styled finger pads 38 or replacement finger pads 38 may be installed within sleeve 36. The sleeve 36 and finger pads 38 of the bowling ball insert 30 thus function to provide a customized fit for a particular finger or thumb of an individual, such that the bowler has improved comfort and control while bowling and may readily adjust the fit based on personal preferences, lane conditions, or the like.

As shown in FIGS. 4-6, sleeve 36 is substantially cylindrical with a generally round and ring-shaped cross-sectional profile, and has an interior surface 42 and an exterior surface 44. Sleeve 36 is preferably constructed of a polymeric or elastomeric or rubber-type material, but may alternatively be constructed of a metallic material or leather or other suitable, semi-rigid or rigid material, without affecting the scope of the present invention. Sleeve 36 is adapted to be secured within a finger hole 32 of a bowling ball 34, where finger hole 32 refers to a hole in a bowling ball 34 that receives one of the digits of a bowler's hand, such as a thumb, middle finger, or ring finger. Sleeve 36 is intended to be fixedly secured within a respective finger hole 32, such as by use of an adhesive, but may alternatively be constructed to be removably positioned within the respective finger hole. Although illustrated as having a generally ring-shaped cross-sectional profile, it should be understood that sleeve 36 could be constructed to have alternative geometric profiles and still function as intended within the scope of the present invention. For example, a sleeve of the present invention could have an oval outer cross-sectional profile or an outer cross-sectional profile that includes generally straight lines, such as square or triangular (for use in similarly constructed holes or bores in the bowling ball), and a circular or oval inner profile.

Sleeve 36 includes a pair of substantially diametrically opposed insert member receptacles 46 located on the interior surface 42. Each insert member receptacle 46 is formed to include an insert member fastening element 48 and a sleeve notch 40. In the illustrated embodiment, insert member fastening element 48 is positioned on either side of sleeve notch 40 and is constructed from one of the materials or portions or elements forming hook and loop type fastener, such as VELCRO® brand hook and loop type fastener supplied by Velcro USA, Inc. of New Hampshire.

Hook and loop fastener is well-known and is constructed of two elements that are adapted to be selectively and repeatedly joined together and pulled apart. The first element is a loop element or loop tape that has a soft, fuzzy texture and the second element is a hook element or hook tape that is composed of numerous miniature substantially stiff hooks. In the illustrated embodiment, insert member fastening element 48 is constructed from the hook element. As will be described below, finger pads 38 then include loop element such that finger pads 38 may be secured to insert member receptacle 46 of sleeve 36. The hook element of insert member fastening element 48 may be permanently affixed to sleeve 36 by an adhesive, or the like. Optionally, the hook element may be removably affixed to sleeve 36 using double sided tape, or by a temporary adhesive having mastic of limited strength, or suitable means for attaching the hook element to the sleeve.

Although insert member fastening element 48 is illustrated as being located on either side of sleeve notch 40, it should be appreciated alternatively located insert member fastening elements may be employed within the scope of the present invention. For example an insert member fastening element may be located only on one side of a sleeve notch, or below a sleeve notch that does not extend the entire length of the sleeve.

Sleeve notch 40 is constructed as a groove or channel on the interior surface 42 of sleeve 36 and extends longitudinally along the entire length of sleeve 36. As noted above and described in more detail below, sleeve notch 40 is used to enable finger pad 38 to be readily removed. As shown in FIGS. 2-5, sleeve notches 40 intersect the top end 50 of sleeve 36 such that, when viewed from top end 50 of sleeve 36 (FIG. 3), sleeve notches 40 form a cutout 52 on top end 50. Although illustrated as a groove having a generally rectangular cross-sectional profile extending the entire longitudinal length of sleeve 36, it should be appreciated that alternatively formed and sized sleeve notches 40 could be constructed and still function as intended within the scope of the present invention. For example, the sleeve notches could be formed to have a generally semi-circular cross-sectional profile. Furthermore, sleeve notches could be constructed to extend only a limited distance along the longitudinal length of the sleeve, with such alternative sleeve notches intersecting the top end of the sleeve, (such as illustrated in FIG. 3), such that the sleeve notches still aid removal of the finger pads. It should also be appreciated, however, that a bowling ball insert may alternatively be constructed without the above and below discussed notches, grooves, and/or channels and still function as intended within the scope of the present invention.

Although illustrated in FIGS. 4-6 as including two diametrically opposed insert member receptacles 46, the sleeve may be alternatively constructed to include only one or more than two insert member receptacles, or non-diametrically opposed insert member receptacles, and still function as intended within the scope of the present invention. For example, the sleeve could include three insert member receptacles spaced approximately 120 degrees apart on the interior surface, or four insert member receptacles spaced approximately 90 degrees apart on the interior surface. Alternatively, the sleeve could include two insert member receptacles that are not diametrically opposed from each other.

The finger pad 38 illustrated in FIGS. 7-11 has a generally convex first pad side or attachment side or pad attachment side 54, a generally concave second pad side or grip side, or pad grip side 56, and top and bottom ends 58, 60, respectively. As illustrated in FIG. 7, first pad side 54 includes a finger pad fastening element 62, which is adapted to mate with insert member fastening element 48 of insert member receptacle 46, discussed above. Therefore, as illustrated, finger pad fastening element 62 is preferably constructed from the loop element of hook and loop fastener such that it is able to mate with the hook element of insert member fastening element 48. It should be appreciated, however, that finger pad fastening element 62 could be constructed from hook element and insert member fastening element 48 constructed from loop element, without affecting the scope of the present invention. The loop element of finger pad fastening element 62 may be permanently affixed to first pad side 54 by an adhesive or the like. Alternatively, the loop element may be removably affixed to first pad side 54 using double sided tape, or by a temporary adhesive having mastic of limited strength or the like.

Although insert member fastening element 48 and finger pad fastening element 62 are illustrated as using hook and loop fasteners, it should be appreciated that alternative attachment methods could be utilized that enable detachable securing of finger pad 38 to sleeve 36 such that bowling ball insert 30 may function as intended within the scope of the present invention. For example, snaps, buttons, clips, double-sided tape or the like, or other suitable fastening means could be used.

Figure 10:
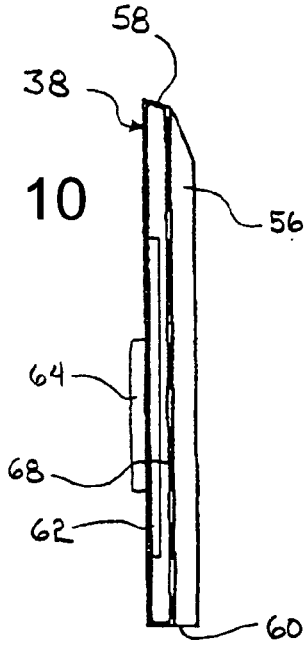
FIG. 10 is a side elevation view of the finger pad of FIGS. 7-9.
Figure 11:
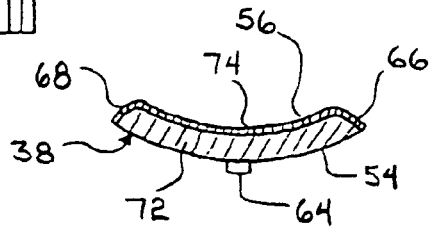
FIG. 11 is a cross-sectional view of the finger pad taken along the line A-A of FIG. 9.

As illustrated in FIGS. 7, 10, and 11, first pad side 54 may also include a locating protrusion, rib, or tab 64. Locating tab 64 is adapted to mate with sleeve notch 40 of insert member receptacle 46 when finger pad 38 is mounted to sleeve 36, and thereby provides increased lateral stability to finger pad 38 when used by a bowler. As illustrated, locating tab 64 is positioned generally centrally between first and second edges 66, 68 of finger pad 38. However, it should be appreciated that locating tab 64 may be omitted from finger pad 38, or may be alternatively positioned side-to-side relative to first and second edges 66, 68 to enable the circumferential position of finger pad 38 within sleeve 36 to be varied, with finger pad 38 still functioning as intended within the scope of the present invention. Optionally, more than one locating tab 64 may be formed on first pad side 54 or may extend a greater or lesser distance along first pad side 54 relative to that shown in FIGS. 7 and 10, but not extending to top end 58, such that sleeve notch 40 is still able to aid removal of finger pad.

As noted, sleeve notches 40 function to aid the removal of finger pads 38 from sleeve 36. As best seen in FIGS. 1-3, cutouts 52 on top end 50 of sleeve 36 and the sleeve notches 40 extending along the interior surface 42 of sleeve 36 form or define a gap 70 between sleeve 36 and finger pads 38. To remove a finger pad 38, a narrow tool, such as a pick or a small flathead screwdriver, or a person's finger nail, or the like, may be inserted through cutout 52 and into sleeve notch 40, and used to pry finger pad 38 from insert member receptacle 46.

Although not shown, an alternative bowling ball insert may be constructed to reverse the location of sleeve notches and locating tabs. For example, finger pads could be constructed to include a pocket, or indent, or notch extending longitudinally along the first pad side and the interior surface of the sleeve could include a tab or a protrusion adapted to engage such a notch on the first pad side of a finger pad.

Top end 58 of finger pad 38, as illustrated, is formed to have a rounded or radiused profile and a beveled lead edge. When finger pad 38 is mounted to a sleeve 36 within the finger hole 32 of a bowling ball 34, bottom end 60 is positioned deeper within the hole 32, and top end 58 of finger pad 38 is positioned in proximity to top end 50 of sleeve 36. The rounded profile and beveled edge of top end 58, therefore, provide an angled or chamfered lead into the finger hole 32 such that insertion of a user's finger is less likely to loosen or move finger pad 38 relative to sleeve 50. The palm side of the bowler's finger is thus supported by the concave second pad side 56 of finger pad 38 when a single finger pad 38 is used with sleeve 36. Both the backhand side and palm side of the bowler's finger may be supported by the concave second pad sides 56 when two diametrically opposed finger pads 38 are used with sleeve 36 (such as shown in FIGS. 1-3). More than two finger pads 38, or larger finger pads covering an increased arc of the interior surface of sleeve 36, may be used to surround or partially surround a bowler's finger.

It should be appreciated, however, that alternative finger pads may be constructed without a rounded profile and/or a beveled lead edge and still function as intended within the scope of the present invention. For example, a finger pad may be formed without either a rounded profile or beveled edge, or may incorporate only one or the other of such a rounded profile and a beveled edge. Still further, a sleeve insert constructed to receive two or more finger pads could be installed with a finger pad having a rounded profile and/or beveled edge and another finger pad without a rounded profile and/or a beveled edge.

As shown in FIG. 11, finger pad 38 is constructed from a core or inner or base material 72 that is covered with an outer layer or coating 74. The core material 72 is preferably a high-density or memory type foam, such as visco elastic foam or resilient polyurethane foam or other suitable material, that is able to conform to the shape of a bowler's finger, but that is also able to regain at least substantially its original shape upon being released by the bowler. It should be appreciated, however, that alternative types of materials may be used for the core material and still enable the finger pad to function as intended without affecting the scope of the present invention. For example, the core material could be constructed of a resilient rubber-type or polymeric material, or the like.

The outer layer 74 is preferably constructed as a layer of material adhered to the core material 72. The material selected for the outer layer 74 is preferably a hydrophobic-type fabric material that at least substantially does not absorb moisture and is able to aid evaporation of moisture deposited on finger pad 38, such moisture typically being from perspiration from the bowler or condensation transferred to the bowler's fingers from a cold drink or the like. Additionally, the fabric material selected for the outer layer 74 preferably is generally smooth with a low coefficient of friction to aid release of the bowling ball 34 by the bowler. Although FIG. 11 discloses outer layer 74 as only covering second pad side 56 of finger pad 38, it should be appreciated that outer layer 74 could alternatively surround or substantially surround core material 72. Outer layer 74 may be affixed to core material 72 by an adhesive, or by a thermal bonding process, or other suitable attachment means or the like.

It should also be understood that outer layer 74 may be alternatively constructed and still function as intended within the scope of the present invention. For example, the outer layers of finger pads could be constructed of materials having various degrees of roughness such that they have a greater coefficient of friction relative to the outer layer 74 discussed above. Providing finger pads having different coefficients of friction would enable a bowler to vary the "feel" of the ball, by installing a finger pad having a desired surface characteristic, depending upon player preferences. Furthermore, the outer layer could be constructed such that a given finger pad would have different areas or zones, each of which has a different coefficient of friction. For example, a material having a slightly higher coefficient of friction could be placed in proximity to the bottom end of the finger pad, such that the tip of a bowler's finger contacts the material, while the remainder of the second pad side could be covered with a material having a lower coefficient of friction. In such a configuration, the bowler would have an increased grip force at the tips of his or her finger, but would still be able to have a comfortable release as his or her finger is drawn out of the hole upon rolling the ball. Further still, the finger pad may be constructed without the inclusion of an outer layer, whereby the finger pad may be constructed of one or more core materials having varying coefficients of friction.

Outer layer 74 of finger pad 38 may also be constructed of variously colored materials or include various trademarks, phrases, symbols and/or logos, or other indicia or the like. Such colors or information would enable a bowler to further customize his or her ball based on personal preferences, sponsorship or the like, or may be used as a marketing means. For example, a business entity such as a bowling alley or bowling merchandise supplier, or the like, could provide finger pads with colors and/or information representing the entity to increase awareness of the goods or services that it provides.

Although not shown, alternatively formed finger pads may be constructed that include a taper from top to bottom. In such a configuration, a finger pad may be constructed to have either a thicker top end and a thinner bottom end, or a thinner top end and a thicker bottom end, such that the longitudinal profile of the finger pad has a wedge shape. Alternatively formed finger pads may also be constructed to cover either a larger or smaller portion of interior surface of sleeve by defining either a larger or smaller arc between the opposite longitudinal edges. Still further, although FIG. 11 illustrates first and second pad sides 54, 56 as being generally parallel curved surfaces, an alternative finger pad could be constructed having a second pad side that is generally planar or not parallel to the first pad side.

Such alternative finger pad configurations noted above may be used to alter the overall shape of the finger hole 32 of the bowling ball 34 to provide a bowling ball insert 30 that is further personalized to a user's specific preferences. For example, a wedge-shaped finger pad may alter the longitudinal pitch of the finger hole 32, and a finger pad having planar second pad sides would alter the diametric span of the finger hole 32. Depending upon the type of finger pad used, therefore, bowling ball insert 30 may provide a bowler with numerous methods to tailor the fit and feel of the bowling ball 34.

Referring now to FIG. 12, a bowling ball insert 130 is shown that is of similar construction to the above discussed bowling ball insert 30, where the similar components or elements of bowling ball insert 130 being shown with similar reference numbers as used in FIGS. 1-11 with respect to bowling ball insert 30, but with 100 added to the reference numbers of FIG. 12. It should be understood that, because of the similarity of bowling ball insert 130 to bowling ball insert 30, not all of the specific construction and alternatives of like referenced parts will be discussed in the following discussion of bowling ball insert 130.

Similar to bowling ball insert 30, bowling ball insert 130 includes a sleeve 136 having an insert member receptacle 146, and a finger pad 138. Bowling ball insert 130 further includes a spacer 176 located between sleeve 136 and finger pad 138 that is used to provide additional tailoring of bowling ball insert 130 to the preferences of a bowler. The spacer 176 may be generally rigid, semi-rigid, or flexible and is used to further alter the size of the bowling ball finger hole. Although shown as including only one insert member receptacle 146, it should be understood that sleeve 136 may include multiple insert member receptacles 136 in the manner described above in regard to bowling ball insert 30 to enable more than one spacer 176 and/or finger pad 138 to be employed.

The spacer 176 of FIG. 12 is illustrated removed from bowling ball insert 130 in FIGS. 13-15 and includes a convex first spacer side or spacer attachment side 178 and a concave second spacer side or receiving side 180. First spacer side 178 includes first spacer fastening element 182, which in the illustrated embodiment is constructed from the loop element of a hook and loop fastener similar to that discussed above in regard to finger pad fastening element 62. First spacer fastening element 182, therefore, is adapted to engage the insert member fastening element (not shown in FIG. 12) of sleeve 136 such that spacer 176 may be detachably affixed to sleeve 136. First spacer side 178 also includes a locating tab 184 adapted to be contained within the sleeve notch 140 of sleeve 136 when spacer 176 is installed in the manner shown in FIG. 12, in order to provide lateral stability to spacer 176. However, the locating tab need not be included and the spacer may still function as intended within the scope of the present invention. Alternative spacers may also be used that cover either a longer or smaller portion of the interior surface of a sleeve by defining either a larger or smaller arc between the opposite longitudinal edges.

As shown in FIG. 13, second spacer side 180 includes second spacer fastening element 186. In the illustrated embodiment, second spacer fastening element 186 is constructed from the hook element of a hook and loop fastener and is adapted to engage the loop element of the finger pad fastening element (not shown in FIG. 12) of finger pad 138. As also shown in FIG. 13, second spacer side 180 includes a spacer notch 188 formed as a groove extending along the longitudinal length of spacer 176. As can be seen with reference to FIG. 12, spacer notch 188 forms a spacer cutout 190 on the spacer top end 192. Spacer cutout 190 and spacer notch 188 thus function to aid removal of finger pad from spacer 176 by enabling a tool or the like to be inserted into spacer cutout 190 and spacer notch 188, such as discussed above. Spacers may also be formed having different thicknesses and/or having second spacer sides with more or less concavity than the first spacer side.

In similar manner to sleeve notch 40 discussed above, spacer notch 188 may be alternatively formed and still function as intended. The spacer notch 188 may even be omitted. Further, second spacer fastening element 186 may also be alternatively located and/or constructed and still function as intended within the scope of the present invention, such as described above in regard to insert member fastening element 48 of sleeve 36.

Figure 20:
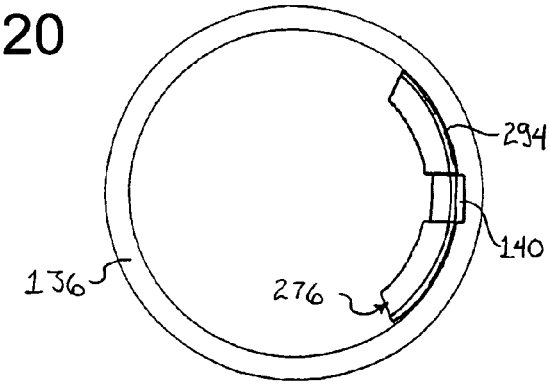
FIG. 20 is a bottom end view of the spacer of FIGS. 16-18 shown installed into a sleeve.
Figure 21:
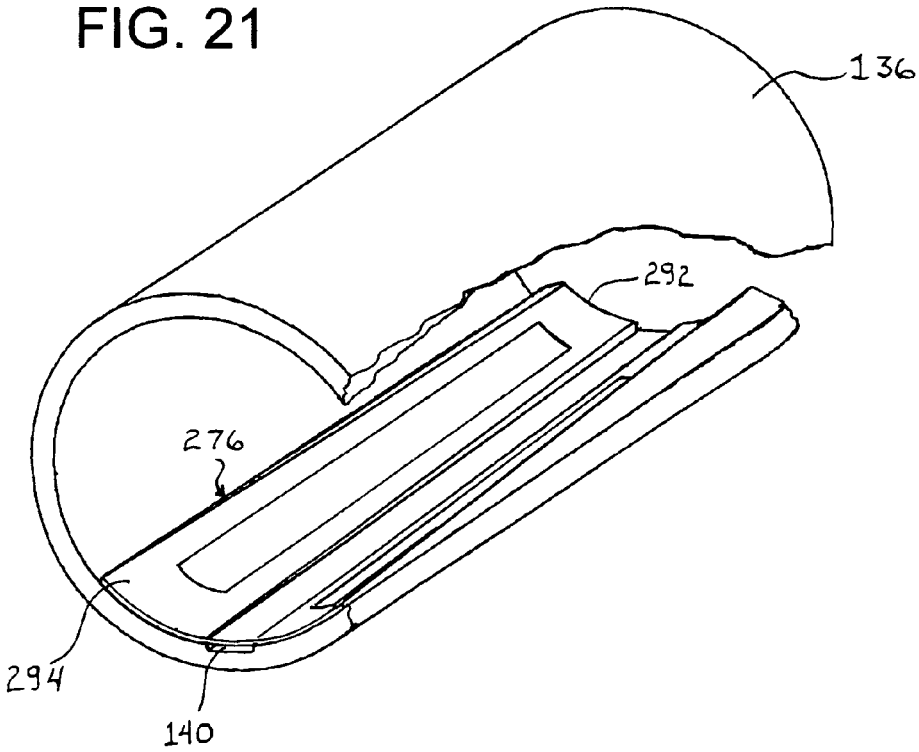
FIG. 21 is a side perspective view of the sleeve and spacer of FIG. 20, shown with a portion of the sleeve removed for clarity.

Referring now to FIGS. 16-21, a spacer 276 for use with bowing ball insert 130 is tapered from the spacer top end 292 to the spacer bottom end 294 to form a generally wedge-shaped spacer 276. As shown in FIGS. 20 and 21, when spacer 276 is installed in sleeve 136, the longitudinal pitch of the sleeve 136 is altered. Spacer 276 thus enables a bowler to alter the configuration of bowling ball insert 130 while using the same finger pad 138 as shown in FIG. 12.

Although illustrated and described above as including notches on the sleeve and spacer, it should be appreciated that an alternatively configured finger pad may be constructed to include a generally similar notch such that a notch may be excluded from either the sleeve and/or spacer while still enabling the finger pad to be readily detached.

The bowling ball insert of the present invention thus provides a durable device that enables a bowler to quickly and easily tailor the fit and feel of the respective finger hole of a bowling ball to the bowler's personal preferences. The finger pad provides a reliable, comfortable, cushioned conforming gripping location for a bowler's finger that eliminates excess movement and prevent blisters and chafing while improving a bowler's performance. In addition, the hydrophobic nature and smooth surface of the outer layer enable a smoother release of the bowling ball for improved technique. Optionally, spacers and finger pads may enable a bowler to modify the bowling ball inserts to conform to a desired feel and, if a ball is used by different bowlers, enable the bowling ball inserts to be conformed to the differently shaped and sized fingers of such users. The sleeve notches, spacer notches, and cutouts enable the finger pads and spacers of the bowling ball inserts to be quickly and easily replaced or changed.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which I claim an exclusive property or privilege are defined as follows:

1. A bowling ball insert intended for installation in a hole of a bowling ball, said bowling ball insert comprising:

a sleeve, said sleeve having an exterior surface and an interior surface;

at least one insert member receptacle, said at least one insert member receptacle being located on said interior surface of said sleeve, said at least one insert member receptacle including an insert member fastening element and a sleeve notch;

at least one finger pad, said at least one finger pad having a pad grip side and a pad attachment side, said at least one finger pad including a finger pad fastening element on said pad attachment side;

at least one spacer, said at least one spacer having first and second spacer sides, said at least one spacer including a first spacer fastening element on said first spacer side, a second spacer fastening element on said second spacer side, and a spacer notch on said second spacer side; and said first spacer fastening element and said insert member fastening element being adapted to enable said at least one spacer to be detachably secured to said sleeve with said sleeve notch being adapted to aid removal of said at least one spacer from said sleeve, and said finger pad fastening element and said second spacer fastening element being adapted to enable said at least one finger pad to be detachably secured to said at least one spacer with said spacer notch being adapted to aid removal of said at least one finger pad from said at least one spacer.

2. The bowling ball insert of claim 1, wherein said insert member fastening element and said first spacer fastening element are constructed of a hook and loop fastener, wherein one of said insert member fastening element and said first spacer fastening element comprise the hook element and the other of said insert member fastening element and said first spacer fastening element comprise the loop element, and wherein said finger pad fastening element and said second spacer fastening element are constructed of a hook and loop fastener, wherein one of said finger pad fastening element and said second spacer fastening element comprise the hook element and the other of said finger pad fastening element and said second spacer fastening element comprise the loop element.

3. The bowling ball insert of claim 1, wherein said sleeve notch is formed as a sleeve groove, said sleeve groove being located on said interior surface and extending substantially the entire length of said sleeve, and wherein said spacer notch is formed as a spacer groove, said spacer groove extending substantially the entire length of said at least one spacer.

4. The bowling ball insert of claim 1, wherein said sleeve includes two insert member receptacles located on said interior surface, said insert member receptacles being adapted to detachably receive either of said at least one spacer and said at least one finger pad.

5. The bowling ball insert of claim 1, wherein said at least one spacer includes top and bottom ends, said at least one spacer being tapered between said top and bottom ends such that said at least one spacer is generally wedge shaped.

6. The bowling ball insert of claim 1, wherein said sleeve notch is formed as a groove, said groove being located on said interior surface and extending substantially the entire length of said sleeve.

7. The bowling ball insert of claim 6, wherein said insert member fastening element is disposed on either side of said groove.

8. The bowling ball insert of claim 1, wherein said sleeve is generally rigid.

9. The bowling ball insert of claim 1, wherein said finger pad is constructed of a high-density foam material.

10. The bowling ball insert of claim 1, further comprising a coating layer on said grip side of said finger pad.

11. The bowling ball insert of claim 10, wherein said coating layer is at least one selected from the group consisting of generally hydrophobic and substantially smooth.

12. The bowling ball insert of claim 1, wherein said finger pad includes top and bottom ends, said finger pad being tapered between said top and bottom ends such that said finger pad is generally wedge shaped.

13. The bowling ball insert of claim 1, wherein said finger pad includes a top and a bottom end, and wherein said top end has a radiused profile.

14. The bowling ball insert of claim 1, wherein said finger pad includes a top and a bottom end, and wherein said top end has a beveled edge.

* * * * *